US009003660B2

(12) United States Patent
Knuchel

(10) Patent No.: US 9,003,660 B2
(45) Date of Patent: Apr. 14, 2015

(54) DEVICE AND METHOD FOR SECURING A WATCH ELEMENT WITH ADJUSTABLE ANGULAR ORIENTATION

(75) Inventor: Daniel Knuchel, Biel (CH)

(73) Assignee: Omega SA, Bienne (CH)

( * ) Notice: Subject to any disclaimer, the term of this patent is extended or adjusted under 35 U.S.C. 154(b) by 178 days.

(21) Appl. No.: 13/488,938

(22) Filed: Jun. 5, 2012

(65) Prior Publication Data

US 2012/0311862 A1 Dec. 13, 2012

(30) Foreign Application Priority Data

Jun. 8, 2011 (EP) ..... 11169051

(51) Int. Cl.

| | |
|---|---|
| ***G04D 3/00*** | (2006.01) |
| ***G04B 45/00*** | (2006.01) |
| ***G04B 37/00*** | (2006.01) |

(52) U.S. Cl.

CPC ..... *G04B 45/0084* (2013.01); *G04B 37/005* (2013.01)

(58) Field of Classification Search

CPC ..... G04D 1/10; G04B 29/02; G04B 39/00; G04B 37/10

USPC ..... 29/807, 896.3; 368/74, 191, 289, 294, 368/308, 309, 319

See application file for complete search history.

(56) References Cited

U.S. PATENT DOCUMENTS

| | | | | |
|---|---|---|---|---|
| 3,614,865 | A * | 10/1971 | Widmer et al. | 68/289 |
| 8,092,077 | B2 * | 1/2012 | Hobor | 368/319 |
| 2002/0067665 | A1 | 6/2002 | Ecoffet | |
| 2002/0167866 | A1 * | 11/2002 | Oomori et al. | 368/191 |
| 2003/0227829 | A1 * | 12/2003 | Megner et al. | 368/309 |
| 2005/0007891 | A1 | 1/2005 | Hiranuma et al. | |
| 2008/0025158 | A1 * | 1/2008 | Hiranuma et al. | 368/308 |

FOREIGN PATENT DOCUMENTS

| | | | |
|---|---|---|---|
| CH | 699 777 | A2 | 4/2010 |
| DE | 889 427 | | 9/1953 |
| EP | 1 727 005 | A1 | 11/2006 |
| EP | 1 890 203 | A1 | 2/2008 |

OTHER PUBLICATIONS

European Search Report issued on Nov. 28, 2011 in corresponding European Application No. 11 16 9051 filed on Jun. 8, 2011 (with an English Translation).

* cited by examiner

*Primary Examiner* — Richard Chang

(74) *Attorney, Agent, or Firm* — Oblon, McClelland, Maier & Neustadt, L.L.P.

(57) ABSTRACT

Device for securing a first element of a watch 1 having a first threaded portion 11 to a second watch element 2 including a second threaded portion 22, including an intermediate element 3 for the angular orientation of the first element 1 relative to the second element 2. The intermediate element 3 includes a third threaded portion 31, arranged for cooperating with the first threaded portion 11 of the first element 1, and a fourth threaded portion 32, arranged to cooperate with the second threaded portion 22 of the second element 2. The thread pitches of the third threaded portion 31 and fourth threaded portion 32 are different.

12 Claims, 2 Drawing Sheets

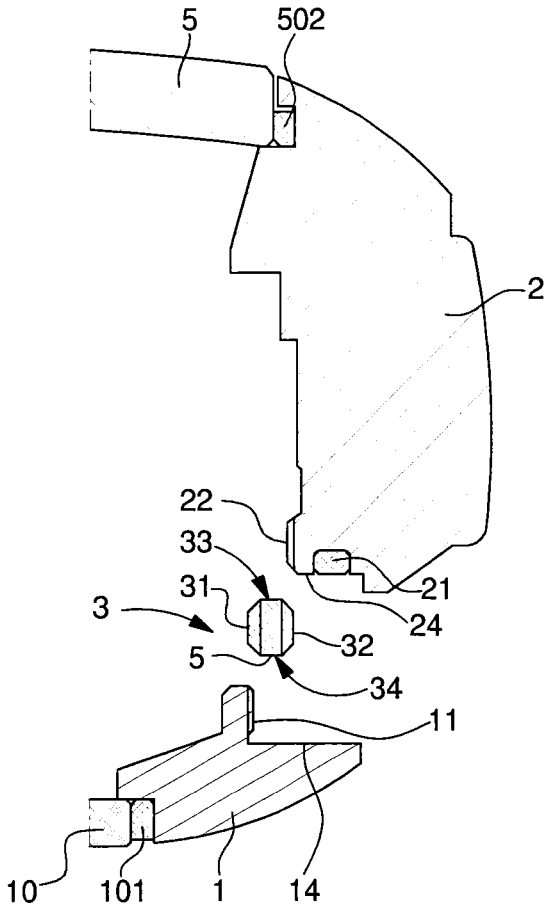
Fig. 1
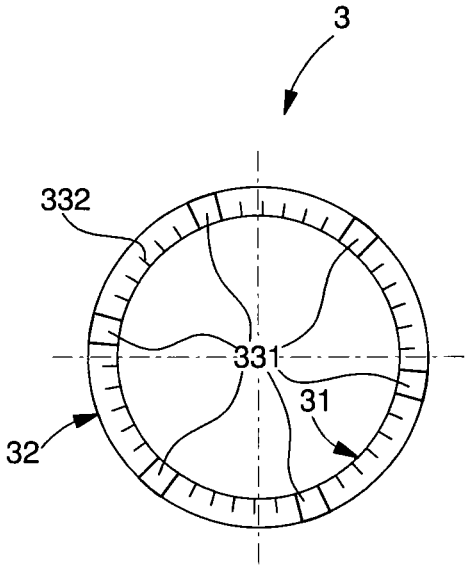
Fig. 2
Fig. 3
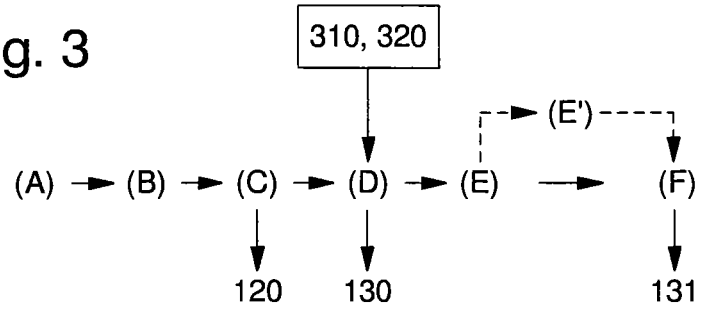

Fig. 4
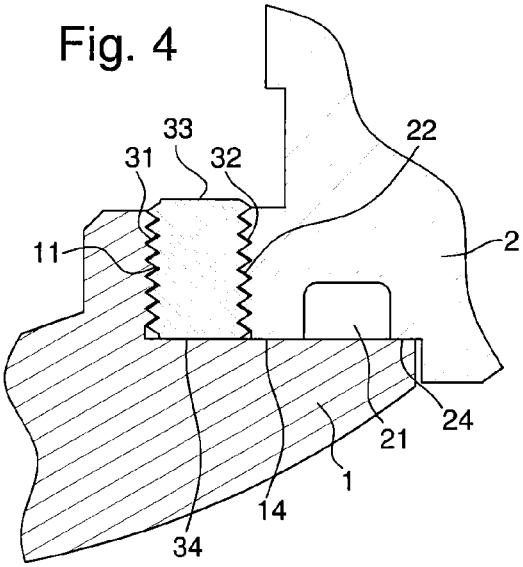
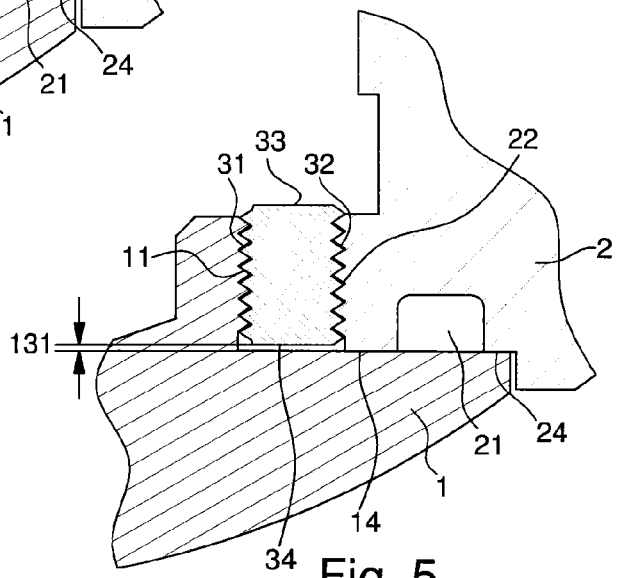
Fig. 5
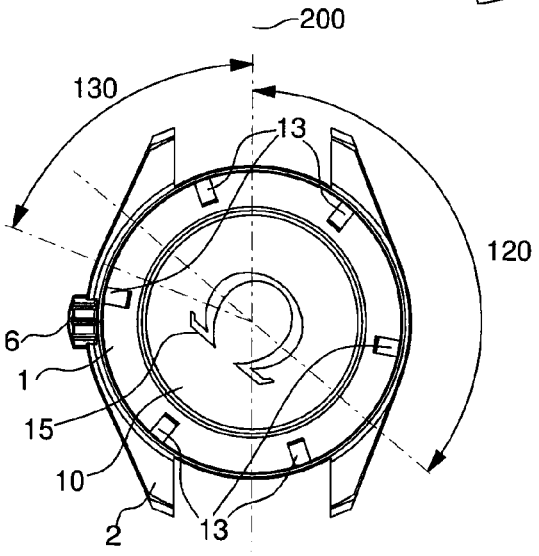
Fig. 4A
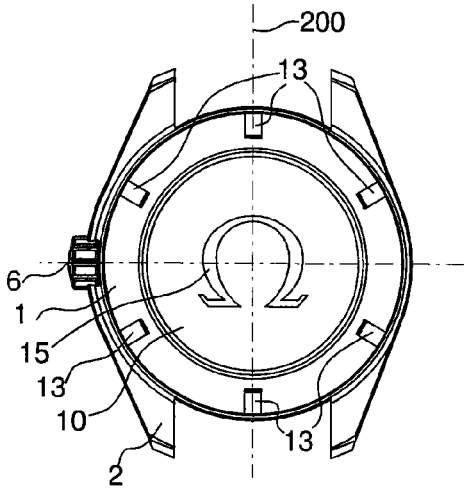
Fig. 5A

DEVICE AND METHOD FOR SECURING A WATCH ELEMENT WITH ADJUSTABLE ANGULAR ORIENTATION

This application claims priority from European Patent Application No. 11169051.7 filed Jun. 8, 2011, the entire disclosure of which is incorporated herein by reference.

FIELD OF THE INVENTION

The present invention concerns a device and method for securing one watch element relative to another with adjustable mutual angular orientation, and more specifically, a securing device and method for a watch case comprising a screw-in back cover, the alignment of which can be adjusted relative to a vertical 12 o'clock-6 o'clock axis.

FIELD OF THE INVENTION

It frequently happens that, when, for example, a back cover of a watch case is screwed onto the middle part thereof, once the back cover is completely screwed in, it becomes noticeable that the decorative markings or patterns, which may for example, have been stamped or etched on the surface of the back cover located on the side of the watch wearer's wrist, are not properly aligned relative to the vertical 12 o'clock-6 o'clock axis, which is of course detrimental to the aesthetic appearance of the watch. Although this defect in appearance may be tolerated for inexpensive watches, it is a very inconvenient drawback for more expensive watches.

To overcome this drawback, usual solutions consist in matching a back cover with a determined watch case during machining, to ensure that once the back cover is completely screwed in it is perfectly aligned with the 12 o'clock-6 o'clock axis of the watch. This solution is, however, unsatisfactory since problems are likely to occur if the original back cover of the watch is lost or damaged and has to be replaced by another back cover, since one cannot be certain that the back cover is properly aligned with the vertical 12 o'clock-6 o'clock axis once it is screwed on to the middle part.

EP Patent No. 1890203 by this Applicant proposes to overcome this drawback by inserting an intermediate ring between the back cover and the middle part, wherein the threads of said ring, respectively cooperating with the back cover and the middle part, are arranged in opposite directions. Thus, when the back cover is completely screwed onto the middle part, it is possible to continue to screw in the back cover, as the intermediate element which connects the back cover is then unscrewed and moves vertically along the middle part. This system certainly allows the alignment of the back cover to be simply and efficiently adjusted relative to the 12 o'clock-6 o'clock axis of the watch, but it has the drawback of not allowing a precise definition of the tightening torque of the back cover on the case. Indeed, once the back cover is screwed as far as possible onto the middle part, it is only the friction forces between the back cover and the intermediate element which prevent the back cover from rotating relative to the middle part.

CH Patent No. 699777 proposes an alternative solution for assembling an adjustable back cover on the middle part of a watch using an adjusting ring acting as an axial stop member to define the angular position of the back cover. The ring is screwed to the middle part or to the back cover with a pre-set tightening torque, whereas the back cover is screwed to the middle part using threads arranged in the opposite direction, so that the ring cannot be driven in rotation when the back cover abuts on the middle part. Thus, unlike the solution described above, the back cover is screwed directly onto a part which is rigidly secured to the watch case. The drawback of this solution is that it requires proceeding by successive estimations to determine the axial position of the ring which matches the desired angular position of the back cover. Moreover, the axial adjustment of the ring degrades the hermetic properties of the back cover since the contact surfaces of the back cover and the middle part are no longer in contact with each other in the assembled position.

SUMMARY OF THE INVENTION

Consequently, it is an object of the present invention to provide a solution for securing a back cover to the middle part of a watch, and more generally one watch element to another with adjustable mutual angular orientation, which is free of known limitations.

These objects are achieved via a securing device according to claim 1, characterized in that it includes an intermediate element, provided with a threaded portion arranged to cooperate with the threaded portion of a first element to be assembled, and another threaded portion arranged to cooperate with the threaded portion of a second element to be assembled, wherein the thread pitches of the threaded portions of the intermediate element are different.

These objects are also achieved via a securing method according to claim 9, wherein an intermediate element is first of all fully screwed onto a first element to be assembled by means of a first threaded portion, then the first element—intermediate element assembly is screwed onto the second element by means of a second threaded portion so that the first element abuts on the second element, the method being characterized in that it includes the following steps:

- visualising an angular orientation of the first element relative to the second element in the assembled position;
- determining an angle of adjustment of the intermediate element relative to the first element according to the thread pitches used for the threaded portions thereof;
- unscrewing the intermediate element from the first element over an angular travel corresponding to the angle of adjustment;
- screwing the first element—intermediate element assembly back onto the second element by means of the second threaded portion so that the first element again abuts against the second element.

One advantage of the proposed solution is that the angular correction can be easily performed according to the difference between the thread pitches used, which is predetermined. The angular adjustment of the intermediate element can thus be carried out in a single operation, instead of by successive estimations.

Another advantage of the proposed solution is that it overcomes deficiencies in terms of tightening torque between the elements to be assembled, without causing any axial movement of the first element relative to the second element in the assembled position, which is not the case when an intermediate element is used as an adjustment stop member. This absence of axial movement consequently does not damage the hermetic properties of the final assembly.

SUMMARY OF THE INVENTION

Other features and advantages will appear more clearly in the detailed description of various preferred embodiments and the annexed drawings, in which:

FIG. 1 shows a cross-section of various elements to be assembled in an unassembled position according to a preferred embodiment of the invention.

FIG. 2 shows a top view of an intermediate adjustment element according to a preferred embodiment of the invention.

FIG. 3 shows a diagram with the sequence of the various assembly steps to be performed and the parameters used for correction.

FIG. 4 shows a cross-section of the various elements assembled following a first assembly step.

FIG. 4A shows a view of an adjustable element in a non final position when the elements are assembled in accordance with FIG. 4.

FIG. 5 is a cross-section of the various assembled elements in the final position.

FIG. 5A shows a view of an adjustable element in a non final position when the elements are assembled in accordance with FIG. 5.

DETAILED DESCRIPTION OF THE PREFERRED EMBODIMENTS

FIG. 1 describes a preferred embodiment of the invention wherein the elements to be assembled are respectively a back cover 1 and a middle part 2. It will, however, become clear upon reading the following description that the invention could also be used, for example, for a crown or a valve. These examples are given by way of non-limiting illustration. The elements to be assembled may also consist of any parts that are rotatably integral respectively with the back cover and the middle part of a watch.

The top of FIG. 1 shows a crystal 5 mounted on middle part 2 with a sealing gasket 502 inserted between the two elements. Similarly, the bottom of the Figure shows portion 10 of back cover 1 which includes an adjustable marking or logo, an example of which is shown below in FIGS. 4A and 5A (the Applicant's logo, referenced 15), and which is mounted on back cover 1, also with a sealing gasket 101 inserted between the two elements.

An O-ring joint 21 is inserted in a conventional manner in an annular groove at the base of middle part 2, along a bottom contact surface 24 thereof, which will come into contact with the top contact surface 14 of the back cover in the assembled position. The purpose of O-ring joint 21 is to guarantee the sealing of the proposed assembly between back cover 1 and middle part 2, when surfaces 14 and 24 are in contact with each other once back cover 1 is in the assembled position on middle part 2.

A first threaded portion 11 is machined on back cover 1 and a second thread 22 is machined on middle part 2. The present invention proceeds from the general idea of using an intermediate element 3 provided with internal and/or external threads to be simultaneously screwed to the back cover and to the middle part, so that back cover 1 and middle part 2 are no longer assembled directly to each other. According to the illustrated preferred embodiment, the intermediate element 3 is a ring provided with a third threaded portion 31 on the inner periphery thereof, which cooperates with the first threaded portion 11 of back cover 1, and a fourth threaded portion 32 on the inner periphery thereof, which consists here of an inner thread of middle part 2 according to the illustrated preferred variant. According to this arrangement, the second threaded portion 22 is arranged on an inner wall of middle part 2, so that the diameter of the ring is reduced. According to a variant it would, however, also be possible to arrange the second threaded portion 22 of the middle part on the external wall so that this threaded portion cooperates with the internal thread of a ring 3, whose external thread would cooperate with a threaded portion 11 of back cover 1. Although other shapes could be envisaged for intermediate element 3, a ring is preferred since it is simple to machine and inexpensive due to its very reduced volume. The ring according to the invention preferably has internal and external threads over the entire height thereof to simplify the manufacturing process and it includes substantially flat top and bottom surfaces (respectively referenced 33 and 34).

FIG. 2 shows a top view of a ring-shaped intermediate element 3 according to a preferred embodiment described in the preceding FIG. 1. In addition to the threaded portions arranged on the internal and external periphery—respectively third threaded portion 31 and fourth threaded portion 32—there are notches which are for receiving the tenons of a gripping tool to make it easier to screw on the ring, arranged on the top surface 33 thereof. These first notches 331 are preferably identical to the second notches 13 of the back cover, so that the same tool can be used to screw the ring to back cover 1 and then the back cover—ring assembly onto middle part 2. Alternative gripping surfaces making it easier to drive the ring in rotation could be arranged on other parts of the ring, for example on the internal periphery instead of threaded portion when the latter is not arranged over the entire height thereof, and could also consist in "male" elements instead of the "female" element depending upon the tools used. The advantage of notches 331 on the top surface 33 of the ring (intermediate element 3) is that this offers a similar configuration to that of a conventional watch back cover, which generally includes notches on the periphery thereof like those illustrated in FIGS. 4A and 5A (referenced 13), so that the operations of screwing the ring to back cover 1 and the back cover 1—ring assembly to middle part 2 can be carried out in a similar way. These arrangements for notches 331 increase the speed of assembly of back cover 1 to the middle part and thus improve productivity.

The ring of a preferred embodiment of intermediate element 3 illustrated in FIG. 2 further includes angular marks 332 facilitating the adjustment operation to re-orient the back cover correctly relative to a predetermined axis, such as for example the 6 o'clock-12 o'clock axis. These angular marks 34 preferably consist of graduations arranged on the top surface of the ring and may, for example, be used in cooperation with an index or any type of mark (not shown) arranged on back cover 1. It should also be noted that, according to a preferred embodiment, the first notches 331 can be used as angular reference marks. In such case, the angular space between two adjacent notches must be chosen to be sufficiently small, such as, for example, less than 15 degrees, to provide granularity rendering any other reference mark unnecessary to perform the corrective angular adjustment of the ring (intermediate element 3) relative to back cover 1, the principle of which is described below.

FIG. 3 is a diagram illustrating the various sequences used in accordance with the invention to assemble back cover 1 to middle part 2. In a first step A, intermediate element 3, which may take the form of a ring according to a preferred embodiment, is fully screwed onto back cover 1 by means of first threaded portion 11, cooperating with third threaded portion 31 of intermediate element 3. According to the preferred embodiment illustrated below in FIG. 4, the element is fully screwed on when the bottom surface 34 of intermediate element 3 comes into contact with top contact surface 14 of back cover 1. Next, in a second step B, the back cover 1—intermediate element 3 assembly is screwed onto middle part 2 by means of second threaded portion 22, cooperating with fourth threaded portion 32 of intermediate element 3, so that back cover 1 abuts middle part 2. This abutment occurs when the top contact surface 14 of back cover 1 comes into contact with the bottom contact surface 23 of middle part 2, as illustrated in FIG. 4.

The relative axial and angular positioning of back cover 1, middle part 2 and ring-shaped intermediate element 3 is illustrated respectively in FIGS. 4 and 4A when screwing step B has been performed. FIG. 4 shows that the surfaces referenced 14 of back cover 1, 24 of middle part 2 and 34 of intermediate element 3 are then located in the same horizontal plane, whereas FIG. 4A shows that the logo 15 arranged on portion 10 of the back cover is oriented at an angle 120 relative to the 12 o'clock-6 o'clock axis 200 of the watch. In addition to the elements already described with reference to FIG. 1, FIG. 4 also shows the threaded portions 31, 32 of the ring (intermediate element 3). It can be seen, on the one hand, that portions 31, 32 are arranged in the same direction, so that the operation of screwing the back cover—ring assembly onto middle part 2 can be performed without any danger of unscrewing the ring from the back cover and, on the other hand, that the thread pitch of the third threaded portion 31 is smaller than the thread pitch of the fourth threaded portion 32, which minimises angular correction of the ring relative to the back cover where necessary. According to an alternative embodiment, the relative sizes of the thread pitches could be reversed, but in that case, the angle of correction of the ring relative to the back cover (referenced 130 in FIG. 4A) would still be greater than that of the prior orientation of the back cover (referenced 120 in FIG. 4A).

The invention allows an angular correction step to be performed simply and quickly on the back cover, owing to the fact that the third and fourth thread pitches 31, 32 are different. To achieve this, the ring (intermediate element 3) simply has to be unscrewed from back cover 1 by an angle which depends on the difference between the thread pitches 310 and 320 of the ring (intermediate element 3), and the ring and back cover 1 then have to be screwed back onto middle part 2 to obtain the desired orientation of back cover 1.

Step C in the diagram of FIG. 3 consists in visualising the angular orientation 120 of back cover 1 relative to middle part 2 in the assembled position, illustrated in FIGS. 4 and 4A. This step may be facilitated by the presence of angular reference marks on the middle part (not shown) and/or back cover 1. Notches 13 of the back cover may also be used for this purpose.

Once the angle of angular orientation 120 has been determined, in a subsequent step D, the angle of adjustment 130 by which intermediate element 3 has to be unscrewed relative to back cover 1 must be inferred according to the thread pitches 310, 320 used for the third and fourth threaded portions 31, 32. According to the illustrated preferred embodiment, the internal diameter of the ring (intermediate element 3) is, for example, 30 millimeters, whereas the pitch 310 of the first and second threads 11, 31 is 0.5 and the pitch 320 of the third and fourth threads 22, 32 is 0.4, i.e. one complete revolution of 360 degrees corresponds respectively to axial movements of the ring of 0.5 and 0.4 millimeters.

In FIG. 4A, which illustrates a watch provided with a middle part 2, a back cover 1 with notches 13 for the screwing operation and including a portion 10 where the Applicant's Omega logo 15 is visible, preferably oriented symmetrically relative to notches 13, and a conventional adjustment crown 6, the angle 120 is equal to around 100 degrees. If back cover 1 is rotated anticlockwise by the same value, it will move away from the middle part by a height of 0.11=0.4 (the value of pitch 310)*100/360. Consequently, for back cover 1 to abut on middle part 2 again, the ring (intermediate element 3) has to be rotated 0.11 mm deeper into middle part 2, which means, for a thread pitch of 0.5, at a correction angle 130 of 80 degrees. It should also be noted that, whichever thread pitches 310, 320 are selected, the angle of adjustment 130 is inferred from the angle of orientation 120 determined in step C simply by multiplying the pitch ratio. In other words, the following relation is established: 130=120*310/320 and, according to a particular preferred variant, this ratio is preferably chosen to be less than ½, so that the angle of correction is always less than 180 degrees, which results in an easy operation if the operation is performed manually. An angle of more than 180 degrees would require a more awkward operation where the amplitude of torsion of the arm and/or wrist might prove uncomfortable.

Once the angle of adjustment 130 of intermediate element 3 relative to back cover 1 has been determined in step D, in the following step E, intermediate element 3 can be unscrewed from back cover 1 over a corresponding angular travel, which may be made easier by angular reference marks 332 or the notches when the latter are used as angular reference marks. Once intermediate element 3 is in the right position, it must be ensured that the ring will stay locked relative to back cover 1 when the back cover 1—intermediate element 3 assembly is screwed back onto middle part 2. A locking step is not necessary when there are sufficient friction forces between the first and second threaded portions 11, 31, i.e. when said forces are considerably greater than the friction forces acting between the third and fourth threaded portions 22, 32. However, an additional step E' of locking intermediate element 3 relative to back cover 1 will preferably be performed before the subsequent screwing step F, which is carried out by means of the second threaded portion 22, cooperating with the fourth threaded portion 32 arranged on intermediate element 3, so that back cover 1 abuts on middle part 2 again, i.e. the top contact surface 14 of the back cover comes into contact with the bottom contact surface 24 of middle part 2. Locking step E' can be achieved, for example, by electric boring, laser welding, bonding, or by material upsetting.

FIGS. 5 and 5A show the back cover 1—middle part 2 assembly in the final position after screwing step F has been performed. Similarly to FIGS. 4 and 4A, the FIG. 5 cross-section shows the relative axial arrangements of the various elements forming the back cover 1—ring (intermediate element 3)—middle part 2 assembly, with, in particular, the resulting axial displacement 131 of intermediate element 3 relative to back cover 1 corresponding to the value of the angle of adjustment 130 of FIG. 4A, i.e. 0.11 millimeters for the example described. However, FIG. 5A shows that logo 15 arranged on back cover portion 10 is now properly oriented relative to the 12 o'clock-6 o'clock axis 200 of the watch. The only difference between FIG. 4 and FIG. 5 is the axial position of the ring (intermediate element 3), whereas the only difference between FIG. 4A and FIG. 5A is that the orientation of logo 15 has been corrected and the angles of orientation/correction (respectively referenced 120 and 130) have been omitted.

Consequently, it can be observed that the device according to the invention allows simple, quick correction of the orientation of back cover 1 relative to the middle part of a watch 2, simply by using an unscrewing-screwing operation, This device can easily be replicated to the mutual angular orientation of any constituent elements of a watch which require precise positioning relative to a given axis.

What is claimed is:

1. A device for securing a first watch element including a first threaded portion to a second watch element including a second threaded portion, said device comprising:

an intermediate element to angularly orient said first element relative to said second element, the first element including an adjustable marking or logo, wherein said intermediate element includes a third threaded portion arranged to mate with said first threaded portion of said first element and a fourth threaded portion arranged to mate with said second threaded portion of said second element, wherein thread pitches of said third threaded portion and fourth threaded portion are different, wherein the third threaded portion and the fourth threaded portion are arranged on opposing faces of the intermediate element.

2. The securing device according to claim 1, wherein the threads of said third threaded portion and fourth threaded portion are arranged in a same direction.

3. The securing device according to claim 2, wherein the intermediate element is an internal and external threaded ring to form said third threaded portion and fourth threaded portion.

4. The securing device according to claim 3, wherein an internal thread pitch is smaller than an external thread pitch of said ring.

5. The securing device according to claim 4, wherein the ring includes first notches.

6. The securing device according to claim 5, wherein said first notches are arranged on a top surface of said ring.

7. A device for securing a first watch element including a first threaded portion to a second watch element including a second threaded portion, said device comprising:

an intermediate element to angularly orient said first element relative to said second element, the first element including an adjustable marking or logo, wherein said intermediate element includes a third threaded portion arranged to mate with said first threaded portion of said first element and a fourth threaded portion arranged to mate with said second threaded portion of said second element, wherein thread pitches of said third threaded portion and fourth threaded portion are different, wherein the threads of said third threaded portion and fourth threaded portion are arranged in a same direction, wherein the intermediate element is an internal and external threaded ring to form said third threaded portion and fourth threaded portion, wherein an internal thread pitch is smaller than an external thread pitch of said ring, wherein the ring includes first notches, wherein said first notches are arranged on a top surface of said ring, and said first element including second notches, wherein said first and second notches are identical.

8. A device for securing a first watch element including a first threaded portion to a second watch element including a second threaded portion, said device comprising:

an intermediate element to angularly orient said first element relative to said second element, the first element including an adjustable marking or logo, wherein said intermediate element includes a third threaded portion arranged to mate with said first threaded portion of said first element and a fourth threaded portion arranged to mate with said second threaded portion of said second element, wherein thread pitches of said third threaded portion and fourth threaded portion are different, wherein the threads of said third threaded portion and fourth threaded portion are arranged in a same direction, wherein the intermediate element is an internal and external threaded ring to form said third threaded portion and fourth threaded portion, wherein an internal thread pitch is smaller than an external thread pitch of said ring, wherein the ring includes first notches, and said ring further including angular reference marks.

9. A device for securing a first watch element including a first threaded portion to a second watch element including a second threaded portion, said device comprising:

an intermediate element to angularly orient said first element relative to said second element, the first element including an adjustable marking or logo, wherein said intermediate element includes a third threaded portion arranged to mate with said first threaded portion of said first element and a fourth threaded portion arranged to mate with said second threaded portion of said second element, wherein thread pitches of said third threaded portion and fourth threaded portion are different, wherein the threads of said third threaded portion and fourth threaded portion are arranged in a same direction, wherein the intermediate element is an internal and external threaded ring to form said third threaded portion and fourth threaded portion, wherein an internal thread pitch is smaller than an external thread pitch of said ring, wherein the ring includes first notches, and wherein said first notches are used as angular reference marks to facilitate the corrective angular adjustment.

10. A method for securing a first watch element to a second watch element, comprising:

taking the first element having a first threaded portion;

taking the second watch element including a second threaded portion;

taking an intermediate element having a third threaded portion for cooperating with said first threaded portion of said first element and a fourth threaded portion for cooperating with said second threaded portion of said second element;

fully screwing the intermediate element onto the first element by said first threaded portion;

screwing the first element - intermediate element assembly onto the second element by said second threaded portion so that the first element abuts on the second element;

visualizing an angular orientation of said first element relative to said second element;

determining an angle of adjustment of said intermediate element relative to said first element according to the thread pitches used for the third and fourth threaded portions;

unscrewing the intermediate element from said first element on an angular travel corresponding to said angle of adjustment;

screwing the first element—intermediate element assembly back onto the second element by said second threaded portion so that the first element abuts on the second element again.

11. The securing method according to claim 10, further comprising:

locking said intermediate element on said first element after said unscrewing.

12. A device for securing a first watch element including a first threaded portion to a second watch element including a second threaded portion, said device comprising:

an intermediate element for an angular orientation of said first element relative to said second element, wherein said intermediate element includes a third threaded portion arranged to cooperate with said first threaded portion of said first element and a fourth threaded portion arranged to cooperate with said second threaded portion of said second element, wherein thread pitches of said third threaded portion and fourth threaded portion are different, the threads of said third threaded portion and fourth threaded portion are arranged in a same direction, the intermediate element is an internal and external threaded ring to form said third threaded portion and fourth threaded portion, and an internal thread pitch is smaller than an external thread pitch of said ring, wherein the third threaded portion and the fourth threaded portion are arranged on opposing faces of the intermediate element.

* * * * *